US006410832B1

(12) United States Patent
Sterner

(10) Patent No.: US 6,410,832 B1
(45) Date of Patent: Jun. 25, 2002

(54) CAPOTASTO

(76) Inventor: Anders Sterner, Arkövägen 27, Johanneshov (SE), S-121 55

( * ) Notice: Subject to any disclaimer, the term of this patent is extended or adjusted under 35 U.S.C. 154(b) by 0 days.

(21) Appl. No.: 09/720,801

(22) PCT Filed: Jul. 1, 1998

(86) PCT No.: PCT/SE98/01298

§ 371 (c)(1),
(2), (4) Date: Jan. 2, 2001

(87) PCT Pub. No.: WO00/02190

PCT Pub. Date: Jan. 13, 2000

(51) Int. Cl.[7] ..... G10D 3/00
(52) U.S. Cl. ..... 84/318; D17/20
(58) Field of Search ..... 84/318; D17/20

(56) References Cited

U.S. PATENT DOCUMENTS

| | | | | | |
|---|---|---|---|---|---|
| 480,429 | A | * | 8/1892 | Johnsen | 84/318 |
| 3,823,247 | A | * | 7/1974 | Bauerfeind | 84/318 |
| D257,988 | S | * | 1/1981 | Nakamoto | D17/20 |
| 4,324,165 | A | * | 4/1982 | Wilkerson | 84/318 |
| 5,016,514 | A | * | 5/1991 | Kaufman | 84/318 |
| 6,179,538 | B1 | * | 1/2001 | Palm | 411/399 |

* cited by examiner

*Primary Examiner*—Shih-Yung Hsieh
(74) *Attorney, Agent, or Firm*—Jacobson Holman, PLLC

(57) ABSTRACT

A capo that includes a clamping bar (1) which is intended to extend transversely over the fingerboard on the neck of a stringed instrument, and a tensioning device which includes a resiliently bendable tensioning strap (6) whose one end-part (2) is essentially flexurally rigid and connects generally perpendicularly with one end of the bar (1). The other end can be detachably connected to the other end of the bar (1) with the aid of a fastening means (7, 8, 9; 11, 12), so as to clamp the bar (1) securely against the fingerboard with a desired clamping force. The tensioning strap (6) is free-standing from bar in its non-tensioned memory state, and the one end-part of the tensioning strap is directed at its connection with the bar in a manner such as to diverge from the undersurface of the neck when no tension is applied to the strap (6). The tensioning strap has in a non-tensioned state a memory form in which the strap holds the components of the fastening means (7, 8, 9; 11, 12) close to their mutual position of engagement. The tensioning strap (6) is pre-formed such that when initially tensioned, it will contact the neck in a peripheral region that lies beyond the symmetry plane of the neck (6) from a corner angle (3) between the one bar end and one end-part (2) of the strap, whereby a force resultant to the area of contact of the strap with the neck (6) strives to hold the neck corner (4) in engagement with the corner angle (3) and therewith tighten or tension the capo.

20 Claims, 1 Drawing Sheet

CAPOTASTO

BACKGROUND OF THE INVENTION

1. Field of the Invention

The present invention relates to a capotasto of the kind with a clamping bar which is intended to extend transversely over the fingerboard on the neck of the stringed instrument.

2. Prior Art

U.S. Pat. No. 5,016,514 teaches a capo which, according to one embodiment, includes a bar that has a recess at one end thereof. A straight highly elastic, plastic tubular member has an end part fitted on the bar and fixed thereto. The remainder of the tubular member extends around the neck of the instrument and has a screw at one end. The neck of the screw is received in a recess in the bar. The tensioned state of the capo can be adjusted, by screwing the screw deeper into the end of the tube. According to another embodiment of the capo taught by U.S. Pat. No. 5,016,514, the spring member includes a coiled tension spring and the bar includes a bore hole at each end. A screw extends through respective bore holes into the end of the coil spring. The coil spring is covered with an elastic sheet.

Examples of known capos of this kind are described in U.S. Pat. No. 3,185,012, U.S. Pat. No. 3,598,012, U.S. Pat. No. 3,823,247, U.S. Pat. No. 3,903,776, U.S. Pat. No. 4,183,279, U.S. Pat. No. 4,475,433 and U.S. Pat. No. 4,823,670.

A capo will preferably be capable of fulfilling several different requirements, as far as possible. It should be easy to remove and fit the capo to and from the neck of the instrument, and also capable of being easily moved to desired positions along the instrument's neck and there quickly fastened in a simple manner. The capo should present the smallest possible obstacle to hand movement along the neck of the instrument and it should also minimise unintentional changes in pitch.

The aforesaid known capos are unsatisfactory with respect to one or more of the above requirements.

SUMMARY OF THE INVENTION

Accordingly, one object of the present invention is to provide a capo which essentially satisfies the requirements.

Other objects of the invention and advantages afforded thereby will be apparent from the following description, or can be perceived therefrom.

These objects are achieved with an inventive capotasto that has the features that include a clamping bar which is intended to extend transversely over the fingerboard on the neck of a stringed instrument. A tensioning device is provided and it includes a resiliently bendable tensioning strap.

The strap has two end parts, and one of the end-parts is essentially flexurally rigid and connects generally perpendicularly with one of the ends of the clamping bar. The other end can be detachably connected to the other end of the bar with the aid of fastening means, so as to clamp the bar securely against the fingerboard with a clamping force. The tensioning strap is free-standing from the clamping bar in its non-tensioned memory state, and the one end-part of the tensioning strap is directed at its connection with the bar in a manner such as to diverge from an undersurface of the neck when no tension is applied to the tensioning strap. The tensioning strap has a non-tensioned state and the non-tensioned state is a memory form in which the strap holds the components of the fastening means close to their mutual position of engagement.

The tensioning strap is pre-formed such that when initially tensioned, it will contact the neck in a peripheral region that lies beyond a symmetrical plane of the neck from a corner angle between the one bar end and the one end-part of the tensioning strap. Accordingly, a force resultant to the area of contact of the strap with the neck holds the neck corner in engagement with the corner angle when the capotasto is tightened.

Further embodiments of the inventive capotasto are that the other end of the tensioning strap is designed to generate an initial displacement effect that causes a neck corner to be driven into a corner angle as parts of the fastening means are brought into fastening engagement.

Also, in another embodiment, the tensioning strap is integral with the bar, and the fastening element is comprised of a screw carried by the tensioning strap, and a nut carried by the screw. The other end of the bar includes a recess which is open, and the recess opens towards the other end of the bar and receives the screw.

The capotasto also defines the nut as generally conical having a narrower end, wherein the narrower end of the nut is for resting against an edge of the recess.

Other features of the capotasto are that the other end of the bar is rounded at the recess, and a thicker end of the nut includes a semi circumferential edge flange.

The capotasto has a side of the bar that faces towards the fingerboard and carries a clamping pad which includes on the side facing towards the bar an undercut projection which is snapped. The undercut projection is for snapping into a corresponding undercut groove in the bar, and the tensioning strap is essentially non-stretchable in its longitudinal direction.

The fastening element includes a rod which is fixed to the free-end of the strap and carries a row of teeth. Another tooth, located on the free-end of the bar, is intended for engagement with the row of teeth. The mutually co-acting teeth are directed to facilitate closure of the components of the fastening element and to counteract separation of the components along the row of teeth.

The inventive capo includes a clamping bar which is intended to extend across the finger board on the neck of a string instrument, and a tensioning means which includes a resiliently bendable tensioning strap whose one end is essentially flexurally rigid and connects with one end of the bar essentially at right angles thereto, and whose other end can be detachably connected to the other end of the bar by means of a fastening device, such as to tension the bar against the fingerboard with a desired clamping force, wherein the tensioning strap is free-standing from the bar in its non-tensioned memory state, and wherein at its junction with the bar said one end-part of the tensioning strap is directed so as to diverge from the adjacent surface of the neck of the instrument when the strap is not under tension. The memory shape of the tensioning strap is such that the parts of the fastening device will be held close to their mutual positions of engagement in the non-tensioned state of the capo. The strap is constructed so that as it is tightened it will initially contact the neck of the instrument in a circumferential region that lies beyond the symmetry plane of said neck, as seen from said one end-part, whereby a force resultant to the initial pressure-contact area of the strap against said neck will tend to pull an angled corner defined by one end of the bar and one end-part of the tensioning strap into engagement with the adjacent corner on the neck of the instrument as the fastening means is tightened.

The other end-part of the tensioned strap is configured and directed so that when in contact with the adjacent peripheral part of the neck of the instrument it generates a wedging effect which causes the capo to be displaced so that said corner receives the adjacent corner of the neck as the parts of the fastening means are fastened together.

Because the capotasto strap has a memory form and a degree of springiness such that the capotasto will lie shape-bound around the neck of the instrument even though subjected to gravitational forces, the capo will not fall from the neck of the instrument even when the fastening device is open. When open, the capotasto will normally be free to move along the neck of the instrument while, as before mentioned, the components of the fastening means are constantly in the immediate vicinity of each other and therewith readily fastened by the user.

In preferred embodiments of the invention, the components of said fastening means can be snapped into effective engagement with one another with finger force. The fastening means may alternatively include a screw/nut tightener which will enable the fastening or tensioning force to be adjusted.

Because the force resultant of the surface pressure of the strap against the neck of the instrument is directed towards the inner corner defined by said one end of the bar and said one end-part of the strap, the capo will remain in its initial position.

The tensioning strap is elastically flexible in at least that end-part which connects with the one end of the bar. The one end of the tensioning strap is connected to the bar so as to be flexurally rigid at the connection point and is directed so as to diverge from the undersurface of the neck when the strap is not under tension. As a result, the capotasto will project minimally beyond the cross-sectional profile of the neck of the instrument on the discant side, while the adjacent outer edge of the fingerboard is received stably in the corner defined by the bar and the tensioning strap. Furthermore, the force resultant of the contact forces of the tensioning strap against the underside of the neck will be directed generally towards the corner angle, therewith holding the capo stably in its set position on the neck of the instrument. The aforesaid corner also forms an anvil means against which the edge of the fingerboard is placed when fastening the capotasto. This eliminates the risk of the strings being pulled obliquely by the capo as it is being secured to the instrument (this being one cause of undesirable pitch changes).

Although the inventive concept can be applied with several earlier types of capo, it is preferred that the fastening means of the capo is located at that end of the bar which lies opposite to the end that carries the tensioning strap, so that the fastening means will be able to fit in the gap between the finger tips and thumb of one hand with said hand placed typically around the neck of the instrument and moved therealong. As a result of the position of the fastening means, the minimised projection of the bar on the discant side of the fingerboard, and because the capo as a whole can be given a very slender construction owing to the fact that the major part thereof is subjected to tension forces, a capo that is constructed in accordance with the inventive principle will encroach on the space of the user's hand only to a very small extent. This enables the capo bar to be placed close to the top of the gripping strap without impeding the hand to any appreciable extent. The gripping strap will then function as an anvil means and prevent the strings from being depressed more than is necessary. Another, and more common, reason why tuning of an instrument is impaired when using a capo (both in relation to accompanying instruments and to the individual strings of the instrument being accompanied) is precisely because the capo presses the strings down against the fingerboard to an unnecessary extent.

According to one particularly preferred embodiment of the invention, the essentially rigid capo bar is integral with the tensioning strap, wherein at least the end-part of the tensioning strap that adjoins the capo bar is semi-rigid (i.e. elastically flexible under the influence of the fastening means), wherein the end-part of the tensioning strap connecting with said fastener means is preferably given a slightly reduced flexural rigidity in the plane of the capo, wherein the end-part of the fastening strap carries an upwardly extending screw and is held in the immediate vicinity of or in engagement with a recess at the free-end of the capo bar, by virtue of the stiffness of the strap and its attachment to the capo bar, wherein a nut may be screwed onto the screw to enable the tensioning force generated by the capo to be adjusted. The nut may have a general conical shape, so as to enable it to be easily snapped into and out of engagement with the edge of the recess.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The invention will now be described in more detail with reference to exemplifying embodiments thereof and also with reference to the accompanying drawing, in which.

DESCRIPTION OF THE INVENTION

Further in scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
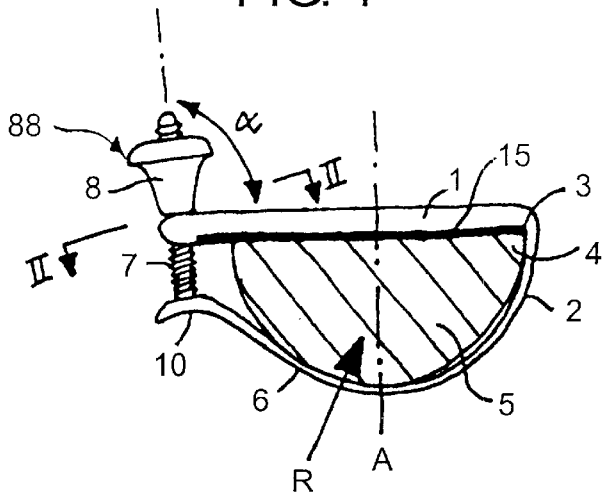
FIG. 1 is a side view of one embodiment of an inventive capo, shown fitted to the neck of a stringed instrument.

Shown in FIG. 1 is a rigid bar 1 which carries at one end a strap part 2 which extends generally at 90 degrees from said bar-end to form an inner corner 3 which receives a corresponding corner 4 on the neck 5 of the instrument, namely the side-edge corner of the fingerboard of said instrument (on the discant string side). It will be seen that the strap part 2 extends free from the undersurface of the neck, in the region that follows from the neck corner 4 down to the lower part of the neck 5.

The strap part 2 constitutes an end-part of a tensioning strap 6 that extends between the ends of the bar 1. The end-part 2 of the tensioning strap 6 is flexurally rigid at the point where it adjoins the bar 1 and is comprised of an elastically flexible, bendable, but generally unstretchable material, which is preferably integral with the bar 1. The tensioning strap 6 carries at its upper end a screw 7 which, in turn, carries a generally conical nut 8 having a thicker end with a semi-circumferential edge flange 88. The strap is preferably made of a material that has a low E-modulus, so that although being unstretchable in its longitudinal direction in practice, despite having a small cross-sectional area, it is, nevertheless, extensible owing to its low bending resistance.

Figure 2:
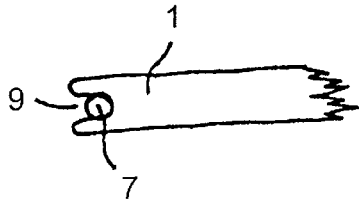
FIG. 2 is a view taken on the line II—II in FIG. 1.

It will be seen from FIG. 2 that the bar 1 includes a recess 9 which is open towards one end of the bar 1 and which receives the screw 7 and forms a support surface for the nut 8. Because the angle $\alpha$ between the bar 1 and the screw 7 is slightly more than 90 degrees when the capo is fitted to a standard neck 5 of the instrument, the screw 7 will tend to move in against the bottom of the recess 9 when the nut 8 is tightened. The upper side of the bar 1 is rounded towards its recess-carrying end, so that the screw/nut unit 7, 8 can be snapped respectively into and out of engagement with the recess 9. By forming the capo, or at least the strap part 2, from a springy, elastic material, the unit obtains the elasticity necessary for the capo to take a correct working position, solely by the user snapping the nut 8 over the recess 9 and/or by manipulating the nut 8 and fastening said nut with the screw 7 lying in the recess 9.

By designing the tensioning strap 6 and the screw 7 in a manner such that the screw 7 will be held in its position adjacent the mouth of the recess 9 or even a position in which it lies in the recess 9 due to the memory-form of the strap and its initial bearing capacity, the capo is able to remain seated around the neck of the instrument even when the fastening means is not fastened. The user can move the capo easily to a desired position on the fingerboard with the capo in this state.

As will be evident from FIG. 1, the strap part 2 has no contact with the undersurface of the neck 5, or only slight contact (when the strap 6 is tensioned) essentially from the corner 4 down towards the symmetry plane A of the neck 5. The force resultant R defines an acute angle with the plane A and is generally directed towards the corner 3. It will be evident, however, that the presence of an exposed gap between the inside of the strap part 2 and the adjacent part of the outside of the neck 5 is not absolutely necessary, since it will suffice for the strap part 2 to provide a contact-pressure release that will give the force resultant R the general direction shown in FIG. 1, so that this resultant force will hold the corner 4 of the instrument against the inner corner angle 3 of the capo. Reduction of the contact force when the capo is firmly clamped is achieved by virtue of the strap part 2 striving to return to its original form (due to the elasticity of the material), which deviates generally from the curvature of the neck 5 of the instrument. When the corner 3 is placed initially against the corner 4, the capo will not be moved transversely as the capo is fastened, thereby avoiding changes in pitch that would otherwise occur if the strings were to be drawn down obliquely when applying the capo.

An important feature of the invention is that the tensioning strap 6 and the bar 1 together define a corner angle 3 which accommodates the corner 4 of the instrument neck in a stable position, wherewith the end-part 2 of the tensioning strap ensures that the resultant of the clamping or tensioning forces will hold the capo in this position on the neck 5 of the instrument, at the same time as the capo is given a low height on both the upper and the underside of said neck 5, and in that the fastening means 7, 8, 9; 10, 11 is placed in a position in which it will not impede the hand of the user. The inventive capo can be given a thin and slender design, since it is subjected essentially to tension forces.

That end of the tensioning strap which carries the fastening means is conveniently provided with a thumb grip 10 to facilitate fastening of the fastening device.

It will be evident from FIG. 1 that the part of the strap 6 connected with the fastening means 7 is relatively rigid and curves away from the surface of the neck 5 of the instrument, and carries the fastening screw 7 spaced from the surface of said neck. The fastening means is "snapped" together with a finger force, by applying generally oppositely directed finger forces against the free-end part of the bar and against the thumb grip 10 on the part 7 of the fastening means, said part 7 having the form of a screw in the illustrated case. This results in a wedging force that tends to move the inner corner 3 of the capo into engagement with the corner 4 of the neck 5 prior to fastening down the fastening means.

The bar 1 is preferably provided with an elastically deformable clamping pad 15 on the side thereof that faces towards the fingerboard.

Figure 4:
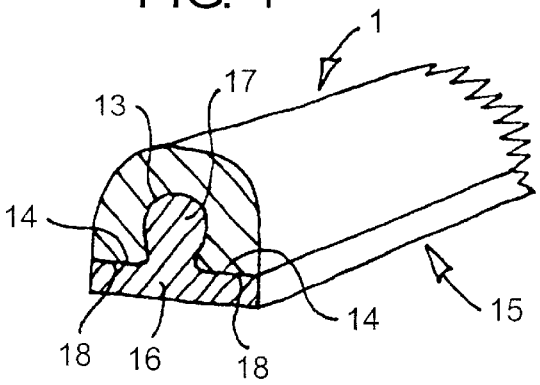
FIG. 4 is a schematic cross-sectional view of one embodiment of the capotasto clamping bar.

As will be seen from FIG. 4, the clamping pad 15 may have the form of a profiled section that includes an undercut bead 17 flanked by support surfaces 18. In this case, the underside of the bar 1 includes a central, undercut recess 13 which receives the bead 17 on the pad 15. The pad 15 will therefore preferably be made of a resiliently elastic material so that it can be deformed as it is snapped into the recess 13. The bar 1 also includes support surfaces 14 on respective sides of the recess 13, for contact with the support surfaces 18. The part 16 of the clamping pad 15 which faces towards the fingerboard has an E-modulus that is adapted to the function of the pad 15.

Figure 3:
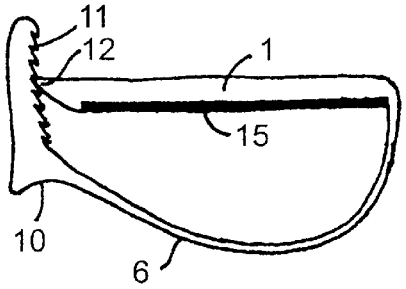
FIG. 3 is a schematic side view of another embodiment of an inventive capo.

FIG. 3 illustrates an embodiment which coincides in all essentials with the embodiment shown in FIG. 1, although with the exception of the fastening means, which in this case has the form of a row of teeth 11 on a rod-like extension of the free-end-part of the strap 6 in the FIG. 3 embodiment. The teeth 11 co-act engagingly with one or more corresponding teeth 12 on the free-end of the bar 1. The teeth 11 of the FIG. 3 embodiment are directed downwards, so that the fastening means 11, 12 will form a type of one-way latch when the free-ends of the strap 6 and the bar 1 are brought together. The fastening means of the FIG. 3 embodiment is loosened by bending outwards the free-end of the rod carrying the teeth 11, so as to move these teeth 11 and 12 out of engagement with one another.

As will be evident from FIG. 1 and FIG. 3, that part of the strap 6 that connects with the fastening means has an outwardly concave finger-grip surface 10 which enables the parts of the fastening means to be brought together with a finger force.

It will also be understood that the strap 6 may be pre-shaped so as to ensure that the force resultant of the surface pressure between the strap 6 and the neck 5 will lie to the left of the symmetry plane A—A in FIG. 1, on the one hand initially as the parts of the fastening means are brought into engagement with one another, and on the other hand also when the capotasto is firmly clamped to the neck of the instrument.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A capotasto, comprising:

a clamping bar having two ends for extending transversely over a fingerboard on a neck of a stringed instrument;

a tensioning device having a resiliently bendable tensioning strap, said strap having two end parts, said one end-part being essentially flexurally rigid and for connecting generally perpendicularly with one of the ends of said clamping bar, and said other end-part being detachably connected to the other end of the bar;

fastening means to clamp the bar securely against the fingerboard with a clamping force, the tensioning strap is free-standing from said clamping bar in its non-tensioned memory state, and said one end-part of the tensioning strap is directed at its connection with said bar in a manner to diverge from an undersurface of said neck when no tension is applied to the tensioning strap, said tensioning strap having a non-tensioned state and said non-tensioned state being a memory form in which the strap holds the components of the fastening means close to their mutual position of engagement; and the tensioning strap is pre-formed such that when initially tensioned, said tensioning strap extends free from said undersurface of the neck in a peripheral region spaced from a neck corner and contacts the neck in another peripheral region that lies beyond a symmetrical plane of the neck from a corner angle between said one bar end and said one end-part of said tensioning strap, whereby a force resultant to the area of contact of the strap with the neck holds the neck corner in engagement with the corner angle when the capotasto is tightened.

2. The capotasto according to claim 1, wherein the tensioning strap is integral with the bar.

3. The capotasto according to claim 1, wherein the fastening means comprises:

a screw carried by the tensioning strap;

a nut carried by said screw; and said other end of the bar having a recess, said recess opening towards said other end of the bar for receiving said screw.

4. The capotasto according to claim 3, wherein the nut is generally conical having a narrower end, the narrower end of said nut for resting against an edge of the recess.

5. The capotasto according to claim 4, wherein said other end of the bar is rounded at said recess.

6. The capotasto according to claim 4, wherein a thicker end of the nut includes a semi circumferential edge flange.

7. The capotasto according to claim 4, wherein a thicker end of the nut includes a semi circumferential edge flange.

8. The capotasto according to claim 1, wherein a side of the bar that faces towards the fingerboard carries a clamping pad which includes on the side facing towards the bar an undercut projection, said undercut projection for snapping into a corresponding undercut groove in the bar.

9. The capotasto according to claim 1, wherein the tensioning strap is essentially non-stretchable in its longitudinal direction.

10. The capotasto according to claim 1, wherein the fastening means includes a rod fixed to a free-end of the strap, a row of teeth positioned on said rod, and a tooth located on a free-end of the bar for engagement with said row of teeth, wherein the mutually co-acting teeth facilitate closure of the components of the fastening means and counteract separation of said components along the row of teeth.

11. The capotasto according to claim 1, wherein the clamping bar further includes a undercut groove in the bar, and a clamping pad with an undercut projection, said undercut projection for snapping into said undercut groove to hold said clamping pad on said clamping bar.

12. The capotasto according to claim 1, wherein said strap forms a flexural rigid connection to the bar.

13. A capotasto for connecting to a fingerboard on a neck of a stringed instrument, said capotasto comprising:

a clamping bar for extending transversely over the fingerboard, said clamping bar having an inner end and an outer end;

a resiliently bendable tensioning strap for extending under the neck of the instrument and having a rigid inner end-part extending from said inner end of said clamping bar for forming a corresponding corner and a detachable outer end-part for connecting to the outer end of the bar, said tensioning strap extending free from under the neck in a peripheral region spaced from said corresponding corner and contacting the neck in another peripheral region that lies beyond a symmetrical plane of the neck; and a fastening element to clamp the bar securely against the fingerboard by fastening said outer end-part of said strap to said outer end of said clamping bar to form a resultant force in said another peripheral region to hold the neck in engagement with said corresponding corner.

14. The capotasto according to claim 13, wherein the tensioning strap is integral with the bar.

15. The capotasto according to claim 13, wherein the fastening element comprises:

a screw carried by the tensioning strap; and a nut carried by said screw; and said outer end of the bar has a recess for receiving said screw.

16. The capotasto according to claim 15, wherein the nut is generally conical and has a narrower end, the narrower end resting against an edge of the recess.

17. The capotasto according to claim 16, wherein said other end of the bar is rounded at said recess.

18. The capotasto according to claim 13, wherein the tensioning strap is essentially non-stretchable in its longitudinal direction.

19. The capotasto according to claim 13, wherein the fastening element includes:

a rod fixed to the outer end-part of the strap;

a row of teeth positioned on said rod; and a separate tooth formed at the outer end the bar which contacts and mutually co-acts with said row of teeth to facilitate closure of the fastening element and counteract separation along the row of teeth.

20. The capotasto according to claim 13, wherein said strap forms a flexural rigid connection to the bar.

* * * * *